United States Patent [19]

Fremow et al.

[11] Patent Number: 4,585,143

[45] Date of Patent: Apr. 29, 1986

[54] LIQUID CONTAINER

[75] Inventors: W. Douglas Fremow, Jeffersontown; James R. Whitworth; Rex R. Atwell, both of Louisville, all of Ky.

[73] Assignee: Boise Cascade Corporation, Boise, Id.

[21] Appl. No.: 573,691

[22] Filed: Jan. 25, 1984

[51] Int. Cl.[4] ..... B65D 5/40; B65D 5/44; B65D 5/60; B65D 5/72

[52] U.S. Cl. ..... 220/462; 206/386; 217/43 A; 220/465; 222/105; 222/107; 229/23 R; 229/23 C; 229/41 C; 251/8

[58] Field of Search ..... 220/461, 462, 463, 403, 220/404, 410, 254, 465; 217/43 A; 206/386, 600, 597; 229/23 C, 41 C, 5.7, 23 R; 222/105, 107, 529; 251/4, 8

[56] References Cited

U.S. PATENT DOCUMENTS

| | | | |
|---|---|---|---|
| 185,249 | 12/1876 | Marshall et al. | 251/8 X |
| 1,765,062 | 6/1930 | Draper | 220/254 |
| 2,357,092 | 8/1944 | De Mian et al. | 229/5.7 X |
| 2,438,351 | 3/1948 | Spanel | 251/4 X |
| 2,738,058 | 3/1956 | Hansen et al. | 206/597 |
| 2,989,208 | 6/1961 | Gibbs, Jr. | 229/5.7 |
| 3,055,568 | 9/1962 | Zalkind | 220/461 |
| 3,061,165 | 10/1962 | Rench et al. | 220/462 X |
| 3,117,615 | 1/1964 | Graven | 251/8 X |
| 3,158,282 | 11/1964 | Housz | 220/461 |
| 3,307,602 | 3/1967 | Boster | 220/254 |
| 3,321,070 | 5/1967 | Childs | 220/460 X |
| 3,433,400 | 3/1969 | Hawkins | 220/404 |
| 3,907,194 | 9/1975 | Davenport et al. | 229/41 C X |
| 4,013,168 | 3/1977 | Bamburg et al. | 217/43 A X |
| 4,019,635 | 4/1977 | Boots | 217/43 A X |
| 4,166,569 | 9/1979 | Begnaud | 229/23 C |
| 4,347,948 | 9/1982 | Hamada et al. | 220/461 X |
| 4,392,606 | 7/1983 | Fremion | 206/600 X |
| 4,421,253 | 12/1983 | Croley | 220/462 X |
| 4,488,661 | 12/1984 | Homma | 220/462 |

FOREIGN PATENT DOCUMENTS

| | | | |
|---|---|---|---|
| 524648 | 12/1953 | Belgium | 217/43 R |

*Primary Examiner*—Allan N. Shoap
*Attorney, Agent, or Firm*—Laubscher & Laubscher

[57] ABSTRACT

A corrugated fibreboard container of tube-and-cap construction has two-walled plastic lining and a bottom side-wall discharge hose. A metal lid-mounting flange in the top end-cap receives a conventional drum lid with vent opening and bung opening threaded to receive a standard plug or a discharge pump fitting to facilitate pumping from the top. A band of reinforcing panels of hardboard mounted on corrugated fibreboard is strapped to the container tube wall and the whole assembly is strapped to a wood pallet for ease of transportation and handling.

19 Claims, 15 Drawing Figures

LIQUID CONTAINER

BACKGROUND OF THE INVENTION

1. Field of the Invention

This invention relates generally to shipping containers for liquids, and more particularly to corrugated fibreboard container assemblies for palletized shipment of liquids.

2. Description of the Prior Art

Many industries use various types of liquids which are received in 55 gallon steel drums. Others receive liquid products in steel tanks of 300 gallon capacity. Normally it is not economically practical to discard such drums or tanks after the liquid contents have been used. In some instances, they are returned to the supplier for refilling. Usually they must be cleaned somewhere before refilling. Environmental considerations dictate care in connection with cleaning operations. The result of the foregoing requirements for liquid containers in common use is an undesirable nuisance and expense.

Efforts to deal with the above-mentioned problem have resulted in only two products of which we are aware, and that have any pertinence to our approach to solving the problem. One is a corrugated "tote" package manufactured by Willamette Industries, Inc. It is a container employing a tube-and-tray type of construction, with a plastic bag confined therein and containing the liquid. The assembly is strapped to a pallet. Although it has a drain outlet in the side near the bottom of the container, there is not provision for conveniently pumping contents from the container top.

Another liquid container is known as the "Liquid Pack" by American Box Company of Fernwood, Miss. It is provided in a capacity of up to 300 gallons. The construction is primarily of wood and is relatively expensive. It does not readily lend itself to emptying by pumping from the top.

The present invention is directed toward solving the aforementioned problems of the steel containers as well as the problems of the above-mentioned Willamette and American Box Company containers.

SUMMARY OF THE INVENTION

Described briefly, according to a typical embodiment of the present invention, a container of tube-and-tray type construction, and made of corrugated fibreboard, encloses a plastic film bag for containing the liquid contents. Laminated hardboard panels are secured around the outside of the tube. A second plastic bag is provided outside the liquid containing bag for added security of the contents. A lid is provided with a standard bung opening for reception of a plug during shipment, and for reception of a pump at the point of use of the contained product. This is sealed to the inner bag and covered in part by the inner bag during shipment.

DESCRIPTION OF THE PREFERRED EMBODIMENT

Figure 1:
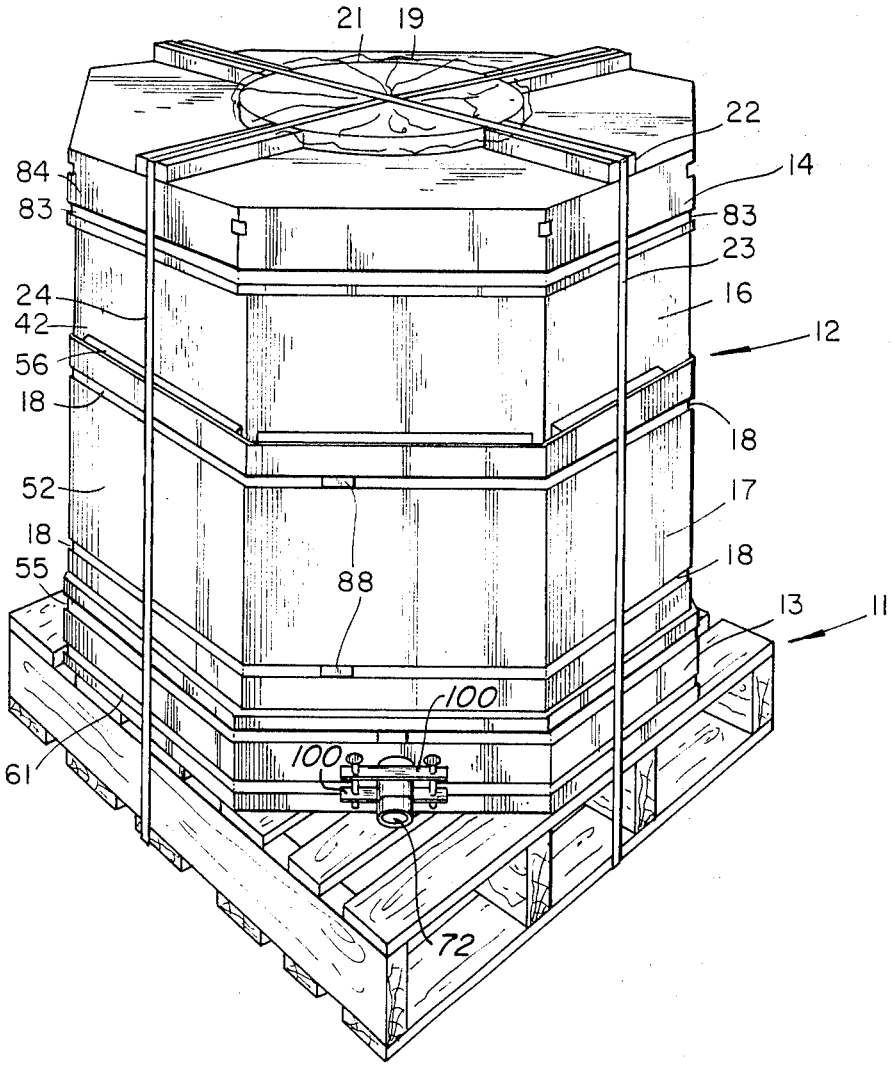
FIG. 1 is a pictorial view of a liquid container assembly according to a typical embodiment of our invention.
Figure 14:
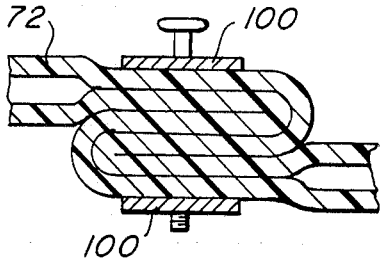
FIG. 14 is a detailed sectional view of the hose when clamped in the S-shaped closed condition.

Referring now to the drawings in detail, the embodiment illustrated in FIG. 1 and which is the typical and preferred embodiment, includes a double-faced, two-way entry, wood pallet 11. This serves as a handling base. The container body 12 has a bottom end cap 13 and top cap 14, both of which are of an irregular octagon shape. They are irregular in the sense that the included angles are not all the same. All eight panels are of the same size (approximately 19 inches wide), and the container precisely fits a wood pallet 45 inches wide and 50 inches long. Consequently, four angles are of one degree dimension and the remaining four angles are of another degree dimension, with the eight angles totaling 360°.

Figure 2:
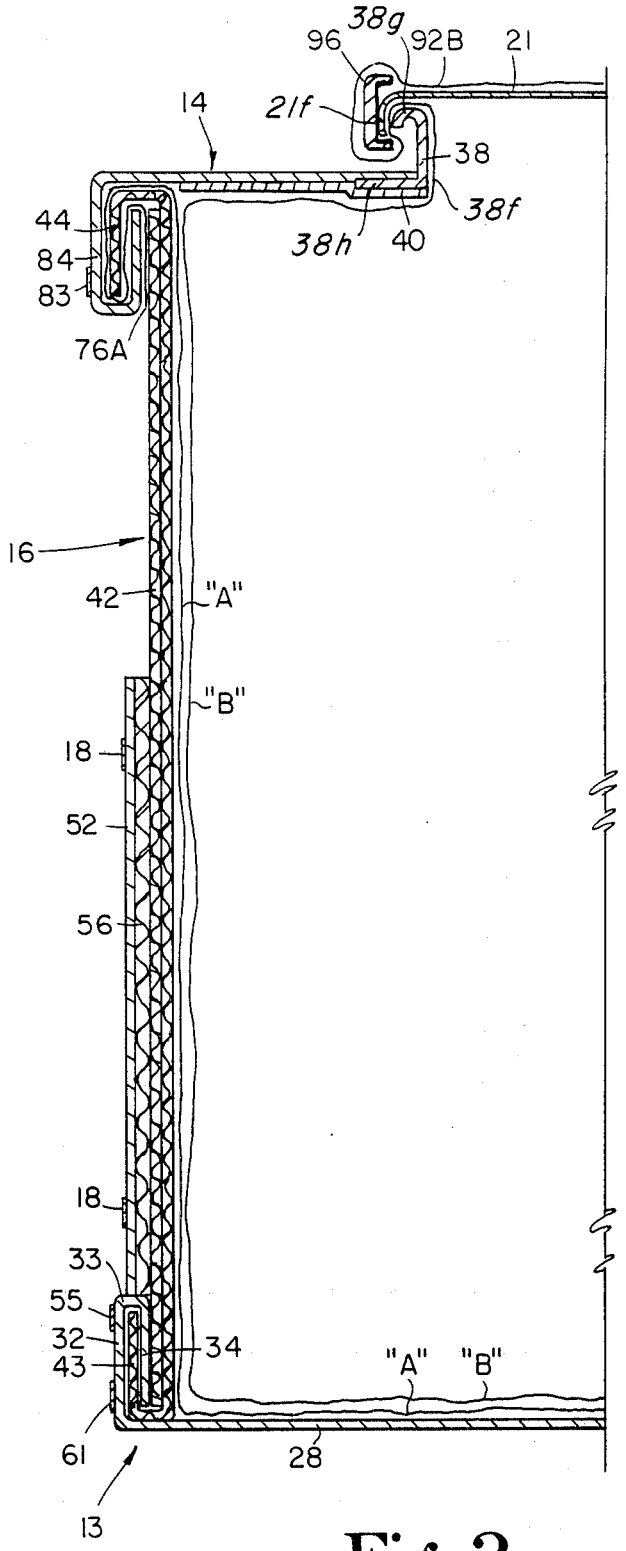
FIG. 2 is an enlarged fragmentary vertical section therethrough, but omitting the pallet.

The container includes a "belly band" assembly 17 secured to the outside of the tube portion 16 by two metal bands 18. An outer portion 19 of an inner bag extends out from under the outer edges of a lid 21 secured to an outlet flange of the cap 14 by a lock ring 96 (FIG. 2). Laminated strapping blocks 22 are provided at four locations and this whole assembly is strapped to the pallet by means of two steel bands 23 and 24 encircling the container and pallet at diametrically opposite locations.

Figure 3:
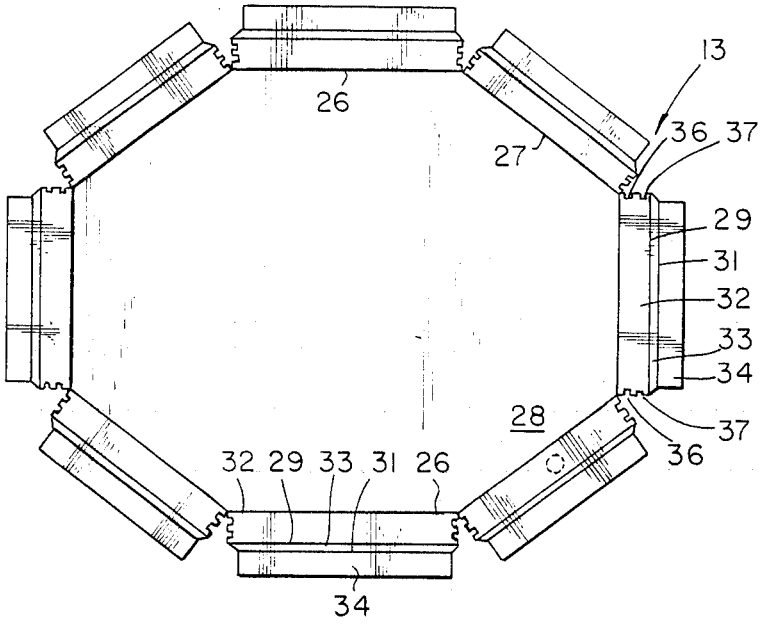
FIG. 3 is a plan view of the bottom cap corrugated fibreboard blank.

Also, it will be helpful if reference is first made to some of the basic components of the container and the assembly method. For that purpose, and referring to FIG. 3, there is shown a blank die-cut from 350 lb. BC DW corrugated fibreboard sheet such as 42K-10W-42K-10W-42K-BC-30# wet strength medium. This material is used in only the top cap, strength panel, bottom cap and belly band, to be described. The blank of FIG. 3 is for the bottom cap 13 and is generally octagonal. All panels are the same in dimension. Eight score lines such as 26 and 27 define the bottom panel 28. Eight flaps are provided. They are identical. Each flap has the score line 29 and 31. These lines and a line as at 26 and 27 define three areas of a flap to be referred to as the proximal portion 32, the intermediate portion 33 and distal portion 34. The proximal portion has two notches 36 and 37 in each edge. The edges of the distal portion are inset with respect to the edges of the proximal portion by an amount equal to approximately the depth of the notches. The direction of flutes or corrugations in each layer of the fluted medium is the same direction throughout, such as vertical in FIG. 3. The incomplete, closely spaced parallel lines running in various directions in the drawing are for purposes of shading according to Patent and Trademark Office drawing standards, and are not intended to indicate direction of flutes in the fluted medium between the liners of the corrugated fibreboard material.

Figure 4:
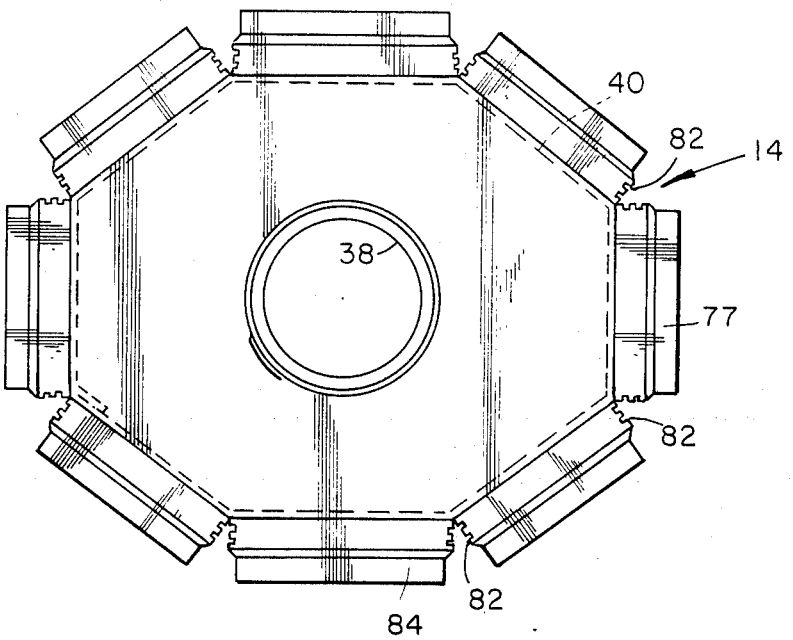
FIG. 4 is a top plan view of the top cap blank assembly.

FIG. 4 shows the die cut blank for the top cap 14. It is the same in all respects to the bottom cap blank except for the provision of a central aperture with a lid mounting flange unit 38 therein. As shown in FIG. 2, this flange unit includes an axially extending cylindrical portion 38*f* with an outwardly and downwardly rolled lip 38*g* at the top. It has a horizontal, radially extending flange portion 38*h* sandwiched and glued between the top cap blank 14 and a strength pad sheet 40 of corrugated fibreboard glued to the bottom of the blank 14. The top blank and strength pad are cross-laminated, meaning that if the medium flutes run in one direction in the top blank, they run at 90 degrees thereto in the strength pad.

Figure 5:
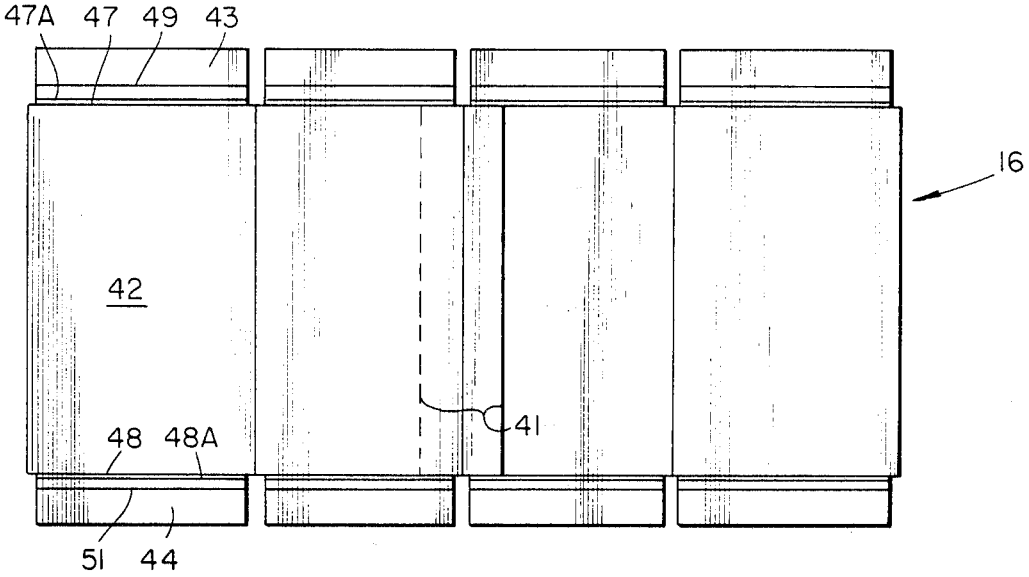
FIG. 5 is a view of the tube blank, showing on a smaller scale than the preceding figures, half of the panels.
Figure 5A:
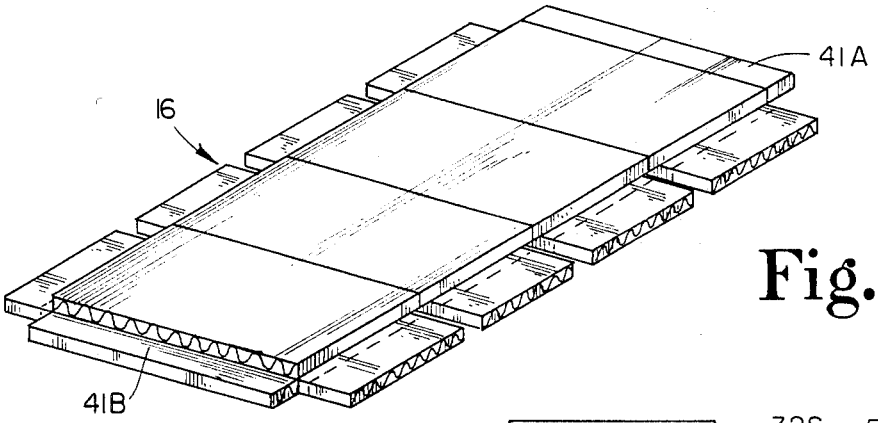
FIG. 5A is a pictorial view of a four panel portion of tube blank, prior to assembly with a like portion by gluing end tabs, to produce the FIG. 5 assembly.

Referring to FIG. 5, there is shown one side of an eight paneled tube blank assembly. The opposite side is excactly the same. The eight-paneled assembly is an assembly of two four-paneled assemblies like that shown in FIG. 5A. Each of these is a cross-laminated assembly of two blanks of 69K-10W-69K-10W-69K-AC-30# wet strength medium, corrugated fibreboard sheet. The outer or upper blank in FIG. 5A (which becomes the outside wall of the container tube portion) has corrugations running horizontally in FIG. 5. Only one layer of medium is depicted in FIG. 5A, in view of the size limitations in the drawing, but two layers of medium are actually there, as this is a double wall material, as indicated above. The outer blank has a glue tab 41A at the far end. The inner blank (lower blank in FIG. 5A), like the outer blank, has four panels of the same size. However, the corrugations of both layers of medium run vertically. Flaps such as 43 and 44 are provided at the top and bottom of each panel. In addition to the score lines 47 and 48 at the top and bottom of the panel, respectively, there are two additional score lines as at 47A, 48A, 49 and 51 on each flap. A glue tab 41B is located at the near end. Tabs 41A of each of the two outer blanks are glued in overlapping relationship to the opposite end panel of the other outer blank. Similarly, tabs 41B of each of the inner blank, are glued in overlapping relationship to the opposite end panel of the other inner blank. This unit, when opened up into an octagon, provides the tube portion of the container.

Figure 6:
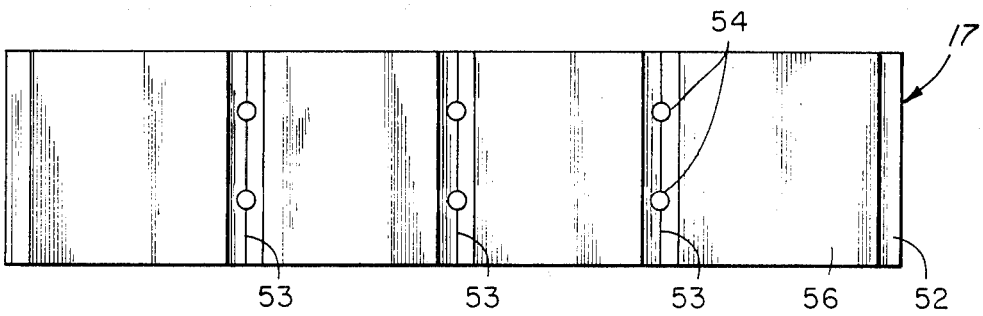
FIG. 6 is a plan view of a "belly band" blank assembly on the same scale as FIG. 5.
Figure 7:
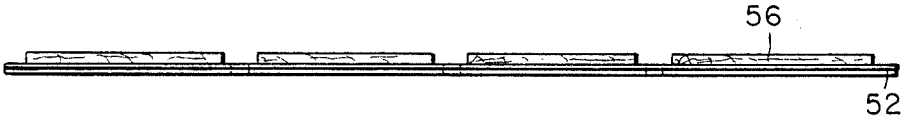
FIG. 7 is a edge view thereof.

FIG. 6 shows a "belly band" unit 17 which includes a sheet 52 of corrugated fibreboard of the same type as top and bottom cap. The corrugations of both layers of medium extend horizontally. The sheet has three score lines 53 thereon and two die cut circles 54 at each of the score lines. A panel of ¼ inch thick hardboard 56 is glued to each of the four panels of the sheet defined by the score lines. An example is Georgia Pacific Standard Class meeting their product standard PS 58-73. It is glued all over to the face of the sheet. Two of these belly band units are provided in the container. All panels are the same size.

Adhesives used to fabricate these components are known. An example is "Aquaflake #31, 23% solids, on the container tube portion. An adhesive known as A-3544 RN lap glue by H. B. Fuller Company, of St. Paul, Minn., is used on the lap joints.

Figure 8:
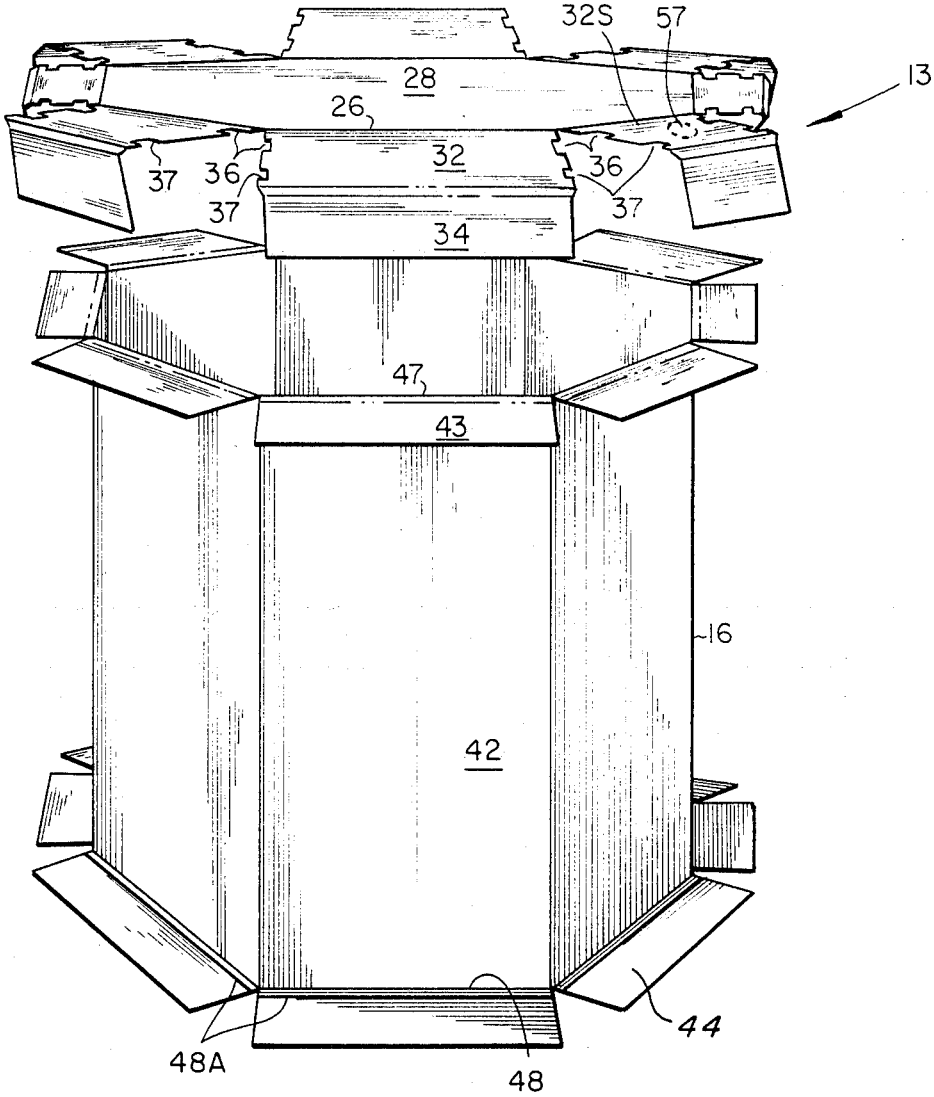
FIG. 8 is a pictorial exploded view showing the tube and bottom cap blank immediately prior to assembly.

Referring now to FIG. 8, the tube blank 16 is shown opened up from its previously flat condition shown in FIG. 5. The bottom and top flaps 43 and 44 are turned outwardly at the score lines, such as 47 and 48 at the top and bottom of each panel. An octagonal template or form suitably sized can be inserted in the tube to hold it in this position during the assembly of the bottom end cap, if desired. The bottom cap 13 FIG. 3 is placed over the top of the container and each of the flaps is bent inwardly and downwardly at the score lines forming the three portions of the flap. The bottom cap is placed on the tube, with the score lines 26 over the corresponding top score line 47 of the tube. Then the distal portion such as 34, is folded under the flap 43. Then the combination is folded down so that the cap flap portions 32 and 34 sandwich the wall flap 43 between them. This same procedure is followed around the container. As this is done, tape such as Scotch brand filament tape ½ inch wide, is applied to the panel 32, being received in notches 37 in the edges of the flaps which are adjacent to each other at the eight corners of the container.

After all of the flanges have been taped in their folded position, flat against the tube panels, they can then be secured with steel bands. An example is ¾ inch by 0.031 thick Magnus PWMWM band made by the Signode Corporation. The steel strapping should begin at a panel which will be facing a corner of the pallet, so that the strap clamps will not project beyond the sides or ends of the pallet.

Figure 9:
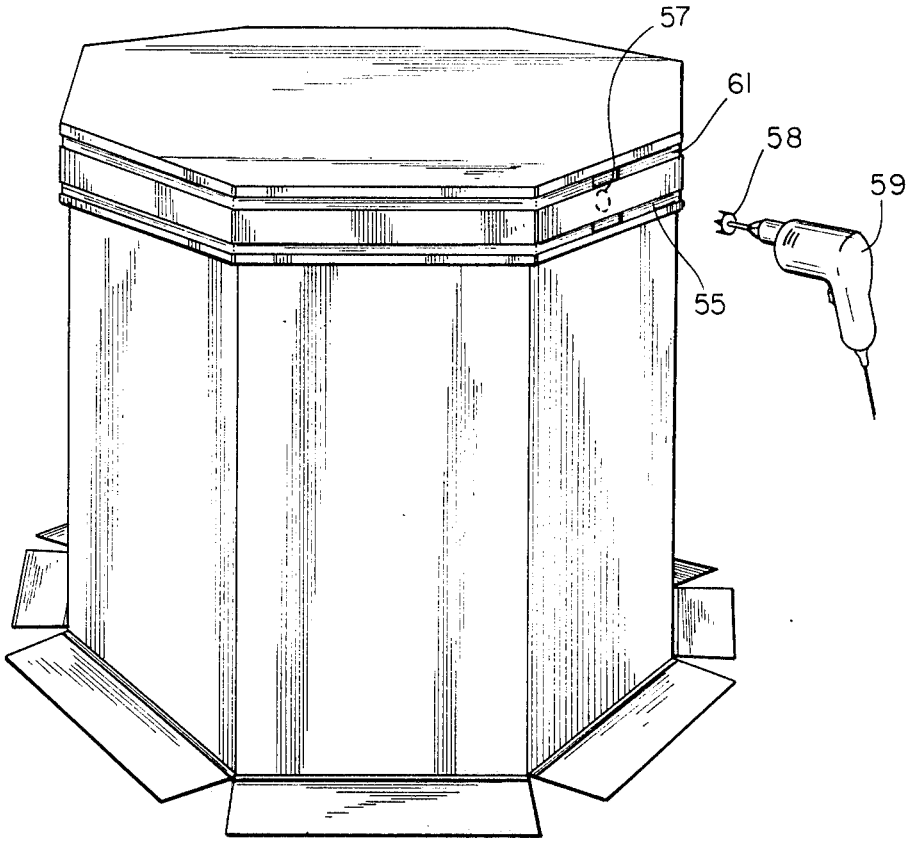
FIG. 9 is a pictorial view of a partial assembly immediately prior to the drain opening drilling step.

There is a flap 32S which has a circular perforation 57 or score. This can then be cut out with a hole saw 58 (FIG. 9) on electric drill 59, to provide an aperture through the entire container wall at this location to accommodate a discharge spout. Then an additional steel band 61 like steel band 55, can be applied in the upper set of notches 36 which will serve to align it as it is installed in the same way as the band 55 was installed. Then the container is turned over.

Then, the belly bands are placed around the container with the hardboard on the inside of the corrugated fibreboard 52 and against the wall of the container. Then two steel bands 18 are applied and tightened to secure the belly bands in place. Again, as before with the other steel strapping, the band crimping is done on a corner panel such as at 88 (FIG. 1). This prevents the crimp joints from interfering with containers located immediately beside them as in a semitrailer, for example, where the pallets and container assemblies conveniently fit side-by-side immediately adjacent and between the trailer side walls.

We mentioned above that there are two plastic liners in our container assembly. Basically these are large plastic bags. They are of a size suitable to contain the entire contents of the 330 gallon container assembly, and have material left over at the top for a suitable closure. A suitable material is polyethylene film. The two bags are the same size, and one is placed inside the other. The outer bag will be referred to as the "A" bag and the inner bag as the "B" bag. The inner bag is to contain the liquid, and the outer bag is to contain any leakage from the inner bag in the event it has somehow become punctured or otherwise damaged. These bags can be furnished with or without drain openings. In the illustrated embodiment, they are furnished with bottom drain openings.

Figure 10:
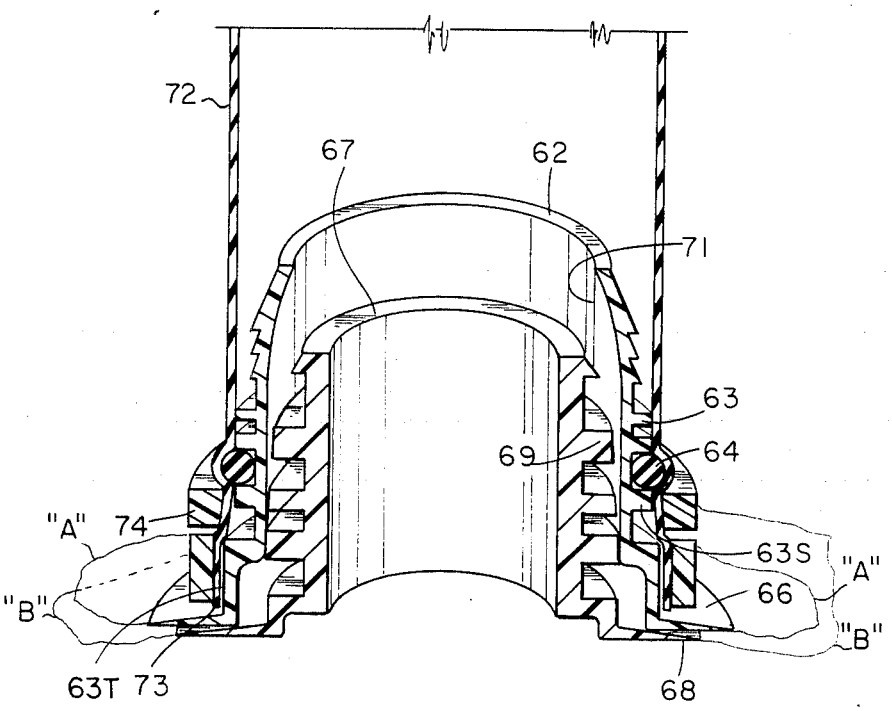
FIG. 10 is an enlarged fragmentary pictorial longitudinal sectional view of the linear spout and discharge hose assembly.

FIG. 10 illustrates a fragmentary portion of the two bags and specifically, the detail of the drain spigots. It should be assumed that the two bags are transparent for purposes of this illustration, although they need not be transparent in the use of the invention. The spigot 62 is made of sturdy plastic and has a plurality of external circumferential ribs 63 thereon. An O-ring 64 is provided in a groove between a pair of these ribs and projects outwardly therefrom. The spigot has a lateral flange 66 which is sealed to the outer "A" bag. The other spigot 67 is of similar construction and has the flange 68 sealed around the small bottom opening in the inner "B" bag. This spigot 67 is pushed into the spigot 62 so that there is a circumferential seal between one or more of the external ribs 69 of the spigot 67 and the slightly tapering internal surface 71 of the outer spigot 62. There may also be some sealing achieved between the materials of the spigots and the bags at the flanges. Assurance of sealing at this location is achieved upon filling the inner bag, due to the force of the mass contained by the inner bag at this location.

The aforementioned aperture 57 in the wall of the container is large enough to receive these spigots. It is not large enough to receive any portion of the flange 66. In order to facilitate the draining of the container by the use of the spigot, a flexible plastic hose 72 is provided. This hose is installed down over the O-ring 64 until the lower end 73 of the hose abuts the flange 66 on the "A" bag. The hose is secured to the spigot by two hose clamps 74 adjacent the O-ring, in a position which would be downstream of the O-ring if any leakage were to occur at the O-ring. These hose clamps sandwich the hose between the clamps and the rib 63S and wall 63T to assure that no leakage can occur at this location, and to also assure that the hose cannot pull off the spigot. This latter feature is important because the hose itself is used as a valve to open and close this outlet of the container assembly. This is done by folding the hose against itself in an "S" shape, and clamping the folds between a pair of bars 100, using winghead thumb screws or bolts as shown in FIG. 1. Therefore, it is essential that the clamps 74 secure the hose 72 to the spigot tightly enough to prevent the maximum internal force developed in the container, whether it be due to the weight of the contents or inertia forces in transport, from forcing the hose off the end of the spigot. A plastic or metal hose-clamp can be used.

After the hose 72 has been assembled and secured to the spigot, the two bags, with the spigots snugly forced together, are installed in the container, with the hose being extended through the opening 57 and the ribbed portions of the spigots extending at least partially through the container wall opening. Then the portion of the hose projecting through and to the exterior, is folded upon itself and clamped, as described above. The desired unfolded length of this hose is from one to two feet, depending upon the intended use.

Figure 11:
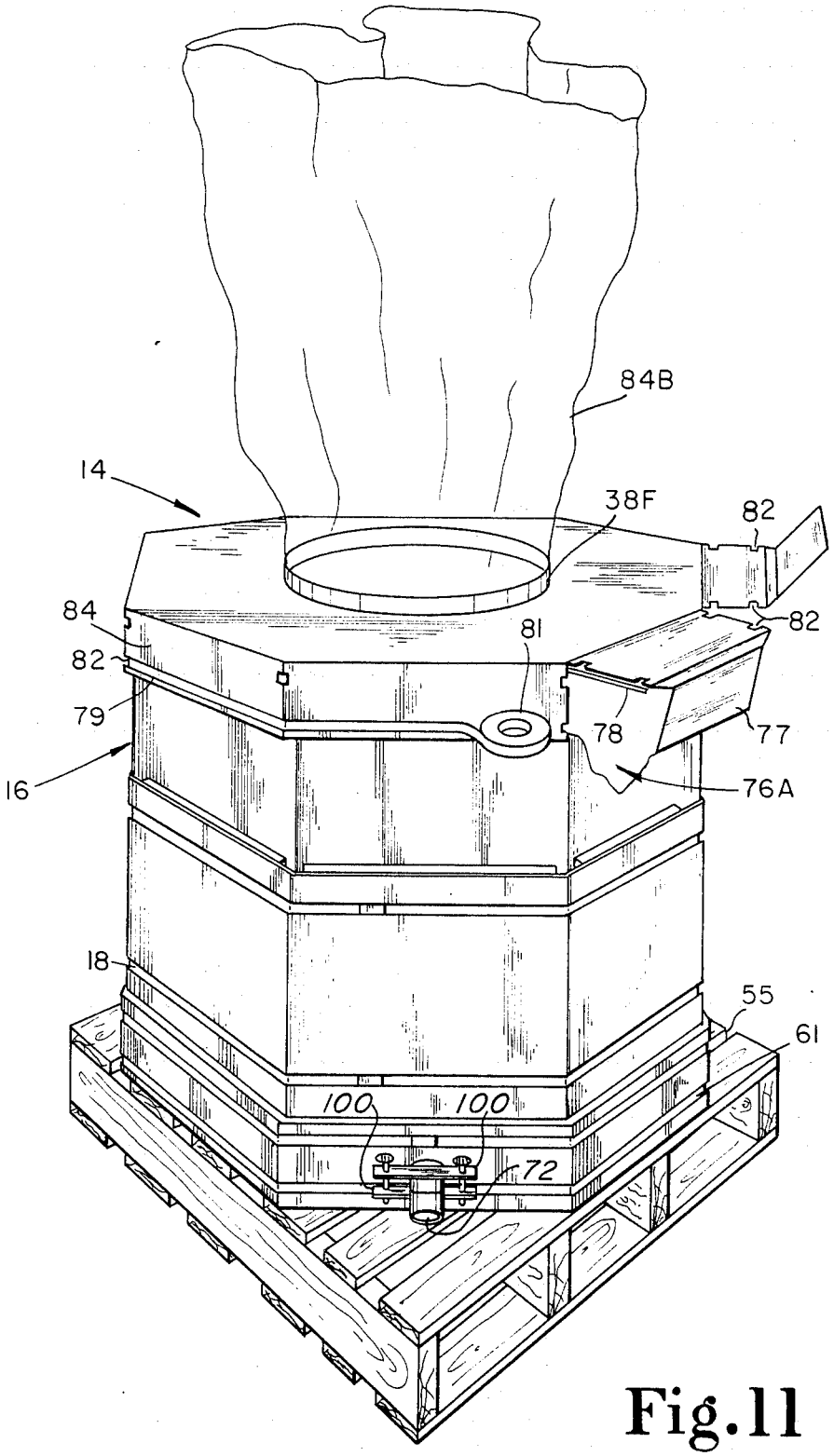
FIG. 11 is a pictorial view of the container assembly during attachment of the upper end cap and belly bands.

Then the container is placed on the pallet in the correct orientation so that it does not extend beyond any edge of the pallet. The outer bag "A" is pulled down over the sides. Then the top end cap 14 is placed over the container in the same way as previously described with reference to FIG. 8. The flaps of the top end cap are folded around the flaps of the container as previously described but, in this instance, the overhanging portions 76A (FIG. 11) of the outer "A" bag are tucked between the distal flap portion 77 of the top cap, and the flap or flange 78 of the tube 16. As this procedure is followed around the container, the filament tape is installed at 79 from a spool 81 in the same manner as described above. The notches 82 in the edges of the flap distal portions assist in the locating and securing of the tape. After all of these flaps have been secured in this way, a steel band is applied over the tape, as shown at 83 in FIG. 12 and permanently secures the cap to the top of the tube 16. Then, the portion 84B of the inner bag, which has been pulled up through the center opening in the top cap (FIG. 11), is folded down over the sides of the container as shown in FIG. 12.

Figure 12:
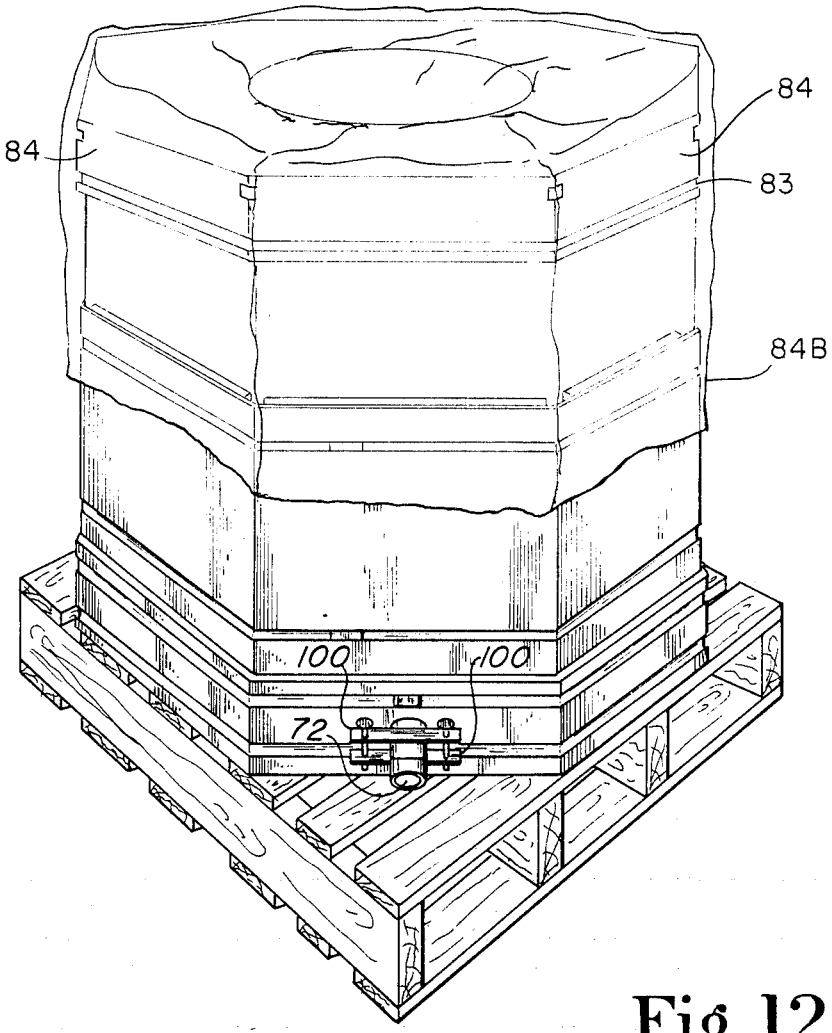
FIG. 12 is a pictorial view of the assembly ready for filling.
Figure 13:
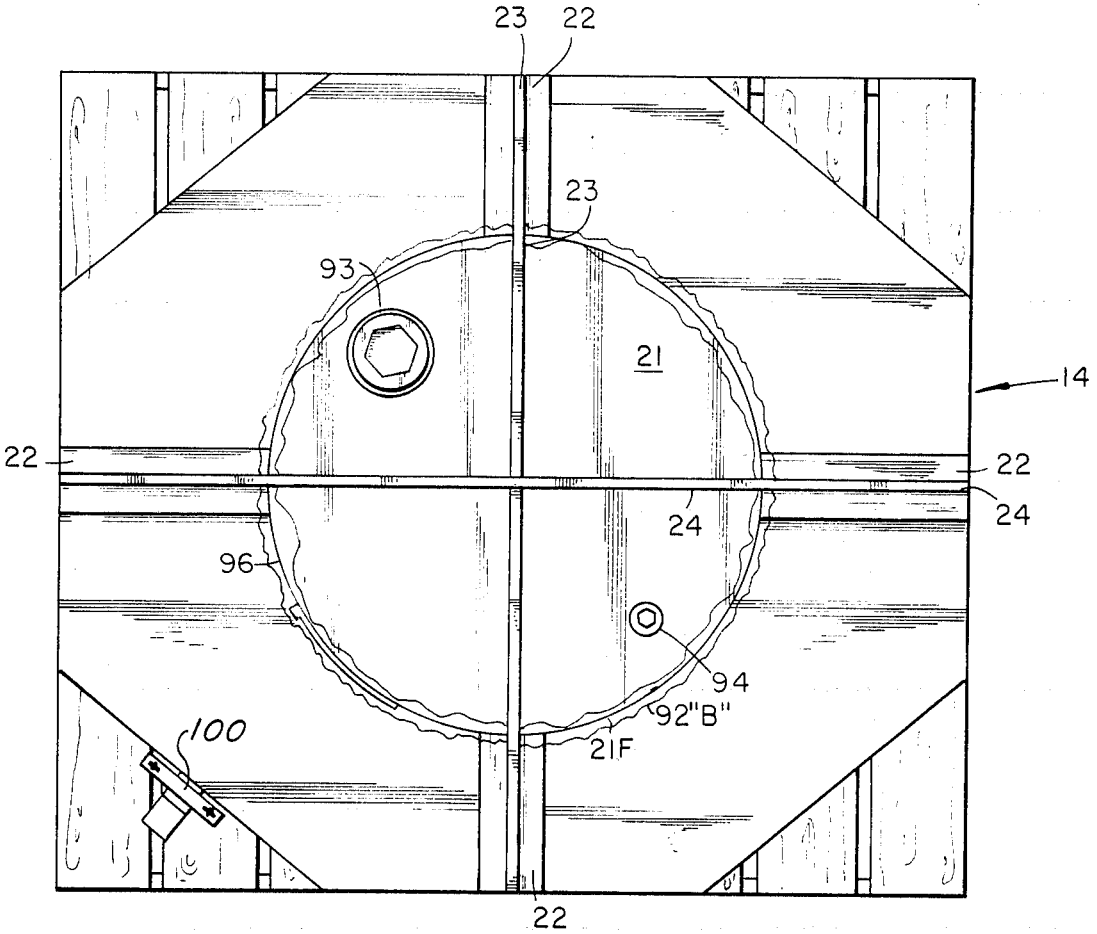
FIG. 13 is an enlarged top plan view of the assembly after banding to a pallet.

After the inner bag portion 84B is pulled down over the side of the container as shown in FIG. 12, it is desirable that the attendant check to be sure that no portion of either bag is bunched up or otherwise in a position to cover the entrance to the spigots. After this is checked, then the container assembly, resting squarely on the pallet, can be filled. When the container is full, the lid 21 (FIG. 13) is mounted on the top flange 38. At this time, the outer bag is sandwiched between the flange and the lid and lid flange 21*f*. The remainder of the bag "B" extends out from the bottom of the lid flange as generally indicated at 92B, although it may extend farther out and still down over part of the sides of the container. The bung opening 93 and vent fitting 94 in the lid should be oriented toward two of the corners of the pallet as shown in FIG. 13. Then the locking ring 96 of the lid can be tightened to secure the lid on the top flange of cap 14. The bung and vent openings are shown with standad plugs threaded into them and sealing them closed for shipment.

Then, bag portion 92B is folded up over the top of the lid, and the four laminated built-up strapping blocks 22 are installed with the inner ends thereof under the lip of the lid and the outer ends flush with the edges of the top cap. Then, with the portion 92 "B" of the bag "B" bunched together on top of the lid, the outer bands 23 and 24 are installed, tightened, and crimped. It is preferable that the crimps be located at the top so as not to interfere with adjacent containers. Thus, the container is now complete, filled and ready for shipment.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A liquid storage container comprising:

(a) an upstanding polygonal tube of corrugated fibreboard having a lower end cap of corrugated fibreboard strapped thereto;

(b) a pair of bags of liquid impermeable material located in said tube, one of said bags being inside the other of said bags;

(c) a top cap containing an aperture, the upper marginal portions of the outer one of said bags being clamped between said top cap and said tube, the inner one of said bags projecting up through said central aperture, the upper marginal portion of said inner bag extending radially outwardly from the said aperture and overlying the top of said cap to provide an opening into said bag at said aperture to permit filling the bag;

(d) drain spigot means connected to said bags for draining at least the inside bag; and (e) a drain tube connected with said spigot means and extending through the wall of said container adjacent the bottom thereof.

2. The container of claim 1, wherein said spigot means includes a pair of spigots in communication with said drain tube and with said bags, respectively.

3. The container of claim 1, wherein said drain tube is folded to define an S-shaped configuration outside said container; and further including a pair of bars located on the folded portion of said drain tube; and two thrust screws mounted to said bars to clamp the bars against the folded portion of said drain tube, whereby the drain tube is clamped shut to hold the contents of said bags.

4. The container of claim 1 and further comprising:

a pallet;

two sides of said container being substantially flush with two sides of said pallet, and two ends of said container being flush with two ends of said pallet, the wall of said container through which said drain tube extends being on a diagonal across a corner of the pallet, with said drain tube being located immediately above the corner of the pallet and recessed from the margins of the pallet at the corner.

5. The container of claim 4 and further comprising:

strapping means extending under at least a part of the pallet and over at least a part of the top cap and tightly fastening the container and pallet together.

6. A liquid storage container, comprising (a) an upstanding polygonal tube of corrugated fiberboard having a lower end cap of corrugated fiberboard strapped thereto;

(b) support means girdling said tube above said lower end cap for supporting said tube against radial outward expansion, said support means including a plurality of hardboard panels having a corrugated fiberboard backing sheet arranged concentrically about said tube, and at least two vertically spaced girdling steel bands mounting said hardboard panels against said tube;

(c) a top cap covering said tube;

(d) a flexible bag in said container and extending successively radially inwardly beneath, and upwardly through an opening contained in the top cap; and (e) a lid covering said opening, said lid being connected with said bag and said top cap outside said opening;

(f) a portion of said bag extending radially outwardly from the margins of said top cap opening and back radially inwardly over said lid to at least partially cover the same.

7. The container of claim 6, wherein said lid contains a threaded bung opening.

8. The container of claim 7, and further comprising:

a double-entry wood pallet;

and straps securing said container to said pallet, said straps extending from under at least portions of said pallet around the sides of said container and across the bag portion on top of the lid of the container.

9. The container of claim 8, and further wherein said pallet has opposite sides longer than its ends, two sides of the lower end cap of said container being flush with two sides of the pallet, and two sides of the lower end cap being flush with two ends of the pallet.

10. The container of claim 9, and further comprising:

a bottom opening contained in said bag, and a hose connected with said bag in communication with said bottom opening and extending through an opening contained in a side of said lower end cap, said hose being folded upon itself and clamped to retain the contents of said container.

11. The container of claim 10, wherein said container is adapted to be filled with a liquid; and further wherein the side of said container having the opening through which said hose extends is on a diagonal line with respect to a corner of said pallet, whereby said hose, when folded, is inset from the sides and ends of said pallet and thereby protected from damage.

12. The container of claim 9 wherein:

the cross-sectional shape of the polygon is an irregular octagon.

13. A liquid storage container, comprising:

(a) an upstanding polygonal tube (16) formed of corrugated fiberboard;

(b) a lower end cap (13) formed of corrugated fiberboard strapped to close the lower end of said tube;

(c) a plurality of panels of hardboard (52) having a corrugated fiberboard backing sheet (56) disposed in an arrangement girdling said tube above said lower end cap;

(d) a generally horizontal top cap (14) mounted to close the upper end of said tube, said top cap containing an aperture; and (e) an annular lid mounting unit (38) mounted concentrically within said top cap aperture, said lid mounting unit including (1) a vertical cylindrical portion (38*f*), extending axially upwardly through said aperture; and (2) a horizontal annular lower flange portion (38*h*) extending radially outwardly from the lower end of said cylindrical portion, said lower flange portion being secured to the lower surface of said top cap;

(3) the upper end of said cylindrical portion terminating in a radially outwardly and downwardly rolled lip portion (39*g*).

14. The assembly of claim 13, and further comprising a drum lid secured to said axially extending cylindrical portion, said lid containing a threaded bung opening adapted for the reception and mounting of a pump to withdraw the contents of the container.

15. The assembly of claim 13, and further comprising a liquid impregnable bag extending up through said aperture and radially outwardly over said axially extending cylindrical portion and downwardly adjacent the external surface thereof.

16. The assembly of claim 13, and further comprising a liquid impregnable bag extending up through said aperture and radially outwardly over said axially extending cylindrical portion of said lid mounting unit.

17. The assembly of claim 16, and further comprising a lid mounted on said axially extending cylindrical portion, said bag being folded up and over said cylindrical portion and pressed against said lid.

18. The assembly of claim 17 wherein:

said bag is filled with liquid material.

19. The assembly of claim 16 wherein:

the capacity of said bag is 300 to 330 gallons of liquid and the container is sturdy enough to hold such liquid having a density of from 9 to 12 pounds per gallon.

* * * * *